US012742373B2

(12) United States Patent
Lemos

(10) Patent No.: US 12,742,373 B2
(45) Date of Patent: Sep. 22, 2026

(54) SUBSEA PUMPING AND BOOSTER SYSTEM

(71) Applicant: Baker Hughes Energy Technology UK Limited, Bristol (GB)

(72) Inventor: Daniel Gruenbaum Lemos, Bristol (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/843,118

(22) PCT Filed: Mar. 3, 2023

(86) PCT No.: PCT/EP2023/025100
§ 371 (c)(1),
(2) Date: Aug. 30, 2024

(87) PCT Pub. No.: WO2023/165740
PCT Pub. Date: Sep. 7, 2023

(65) Prior Publication Data

US 2025/0188822 A1 Jun. 12, 2025

(30) Foreign Application Priority Data

Mar. 4, 2022 (GB) ..... 2203034

(51) Int. Cl.
*E21B 43/12* (2006.01)
*E21B 17/02* (2006.01)
(Continued)

(52) U.S. Cl.
CPC ..... *E21B 43/128* (2013.01); *E21B 41/0007* (2013.01); *E21B 47/07* (2020.05);
(Continued)

(58) Field of Classification Search
CPC ..... E21B 4/04; E21B 17/023; E21B 17/026; E21B 17/028; E21B 33/038;
(Continued)

(56) References Cited

U.S. PATENT DOCUMENTS 6,167,965 B1 * 1/2001 Bearden ..... E21B 47/0175 417/18
7,201,229 B2 4/2007 White et al.
(Continued)

FOREIGN PATENT DOCUMENTS

CN 1831341 A 9/2006
WO 2017/143321 A2 8/2017

OTHER PUBLICATIONS

Search Report issued in GB Application No. 2203034.0, dated Jul. 13, 2022.
(Continued)

*Primary Examiner* — Binh Q Tran
(74) *Attorney, Agent, or Firm* — Hogan Lovells Cadwalader US LLP

(57) ABSTRACT

A subsea pumping and booster system. The system comprises a pumping unit including two electric submersible pumps (ESPs) that are electrically connected by a parallel electrical connection having a first branch and a second branch extending to a respective one of the ESPs. The branches each comprise temperature sensors. The temperature sensors can be used to determine the currents being drawn by each ESP to improve the health and efficiency monitoring of the system. A related method and floating production storage and offloading (FPSO) unit connected to the system is also described.

14 Claims, 4 Drawing Sheets

(51) Int. Cl.
*E21B 41/00* (2006.01)
*E21B 47/07* (2012.01)
*E21B 47/113* (2012.01)

(52) U.S. Cl.
CPC ..... *E21B 17/023* (2013.01); *E21B 17/028* (2013.01); *E21B 41/0085* (2013.01); *E21B 47/113* (2020.05)

(58) Field of Classification Search
CPC ..... E21B 33/0385; E21B 41/0007; E21B 41/0085; E21B 43/12; E21B 43/128; E21B 47/07; E21B 47/113; E21B 49/003; E21B 2200/20
See application file for complete search history.

(56) References Cited

U.S. PATENT DOCUMENTS 7,931,090 B2 * 4/2011 Smedstad ..... E21B 43/128 166/54.1
9,379,544 B2 6/2016 Hazel et al.
10,164,430 B2 12/2018 Strømsvik et al.
2004/0134662 A1 * 7/2004 Chitwood ..... E21B 33/126 166/369
2006/0118310 A1 6/2006 Euphemio et al.
2009/0236144 A1 * 9/2009 Todd ..... E21B 33/0355 175/5
2010/0119380 A1 5/2010 Wilson et al.
2010/0119381 A1 5/2010 Scarsdale
2011/0247825 A1 10/2011 Batho et al.
2016/0251956 A1 * 9/2016 Parra ..... E21B 47/13 340/854.9
2017/0022797 A1 1/2017 Joshi et al.
2018/0314270 A1 11/2018 Grøtterud
2020/0370400 A1 * 11/2020 Guindi ..... E21B 47/008
2021/0246771 A1 8/2021 Ejim et al.
2022/0389770 A1 * 12/2022 Stenshorne ..... E21B 21/08
2025/0129707 A1 * 4/2025 Grande, III ..... E21B 47/135

OTHER PUBLICATIONS

Examination Report issued in AU Application No. 2023227306, dated Sep. 5, 2025.

* cited by examiner

SUBSEA PUMPING AND BOOSTER SYSTEM

TECHNICAL FIELD

The present disclosure relates to a subsea pumping and booster system including two electric submersible pumps (ESPs) electrically connected in parallel. The present disclosure also relates to a method of determining individual currents being supplied to the two ESPs in a subsea pumping and booster system, as well as a floating production storage and offloading (FPSO) unit connected to the subsea pump and booster system.

BACKGROUND

Throughout the life of a subsea oil and gas producing well or during initial production operations, formation pressures or recovery rates may drop or be less than desirable. To account for these drops and provide more viable production rates from such wells, electric submersible pumps (ESPs) can be used to increase production fluid pressure and/or flow from the well.

The ESPs can be integrated into a skid-mounted, modular subsea pumping and booster system positioned external to the well. Such a system can be arranged at mudline, a manifold, or any other reasonable subsea location.

In order to enhance recovery and/or boost the production of fluids from the well, an inlet of the system may receive a fluid from the well and then increase the pressure of the fluid to transport the fluid to another location (such as a floating production storage and offloading (FPSO) unit) using the ESPs. Additionally, the inlet of the system may receive a fluid for injection or use within the well. Fluids utilized with the system may include production fluid, hydrocarbons, water, solids-laden fluids, muds, and the like.

By providing an external, skid-mounted, retrievable pumping and booster system, well production can be increased and pressure stimulation can be provided without intervention into the well itself. This can increase recovery rates, postpone various well intervention operations (e.g., mechanical and/or chemical), and reduce operating expenses.

In a such a subsea pumping and booster system, two ESPs can be fluidly connected and operated in tandem to provide the necessary increase in fluid pressure and/or flow rate. Using two smaller/shorter ESPs compared to one larger/longer ESP can be beneficial, as it allows for the same pressure and flow rate increases, but the system can be packaged in a more compact arrangement.

In order to operate and power the two ESPs in tandem they may be electrically connected in parallel. This allows a single umbilical (e.g., extending from the surface/an FPSO unit) to supply power to the parallel electrical connection to operate the ESPs.

Although operating the two ESPs in this way provides a beneficial arrangement, there is a need for a system that enables monitoring of the current being used to power each individual ESP. Monitoring the individual currents can be used to provide an important indicator of the health and operating effectiveness of each ESP. For example, if an ESP has a blockage, the current can rise, which can be used to ensure the ESP is shut off in time to prevent breakage. The present disclosure addresses these concerns.

SUMMARY

From one aspect, the present disclosure provides a subsea pumping and booster system. The system comprises a pumping unit including two electric submersible pumps (ESPs) for receiving production fluid from a well and being operable to increase a pressure of the production fluid. The two ESPs are electrically connected by a parallel electrical connection. The parallel electrical connection comprises a splitter, a first branch extending from the splitter to a first of the two ESPs, and a second branch extending from the splitter to a second of the two ESPs. The first branch comprises a first temperature sensor, and the second branch comprises a second temperature sensor.

In an embodiment of the above, the first and second temperature sensors each comprise a thermally conductive tube surrounding and in thermal contact with the first and second branches (respectively), and a temperature sensing element attached to the thermally conductive tube.

In an alternative embodiment, the first and second temperature sensors each comprise a temperature sensing element connected directly to the first and second branches, respectively.

In a further embodiment of either of the above, the temperature sensing element is a thermistor.

In a further embodiment of any of the above, the system further comprises a plurality of tubulars for directing flow from a first end to a second end of the pumping unit. The two ESPs are positioned within the plurality of tubulars and are configured to increase the pressure of production fluid to direct it from the first end to the second end.

In a further embodiment of either of the above, the system further comprises a base unit, adapted to receive the pumping unit.

In yet a further embodiment, the base unit comprises a subsea connector for receiving a production line and directing production fluid toward the pumping unit.

In yet a further embodiment, the base unit comprises an isolation valve to block flow of production fluid to the subsea connector.

In a further embodiment of any of the above, the system further comprises a processing unit configured to: receive temperature data from the first and second temperature sensors of the two ESPs and a measure of a total electrical current supplied to the splitter during operation; and determine individual electrical currents being supplied to each of the first and second ESPs via the first and second branches, respectively, therefrom.

In a further embodiment, the processing unit includes: a memory for storing the temperature data from the first and second temperature sensors and the total electrical current value and having instructions saved therein for determining the individual currents being supplied to each of the first and second ESPs using the temperature data and the total electrical current value; and a processor for carrying out the instructions.

In yet a further embodiment of either of the above, the system further comprises an ESP controller electrically connected to the splitter by an umbilical and that is operable to supply the total electrical current to the splitter that is split between the first and second branches to control the two ESPs.

From another aspect, the present disclosure provides a floating production storage and offloading (FPSO) unit connected to the subsea pump and booster system of the above aspect or any of its embodiments. The umbilical extends from the FPSO unit to the subsea pump and booster system. The ESP controller is positioned on the FPSO unit and is a variable speed drive (VSD) for controlling the speed of the two ESPs. A riser extends from the FPSO unit and is connected to the subsea pump and booster system. Production fluid is communicated to the FPSO from the subsea pump and booster system via the riser.

From yet another aspect, the present disclosure provides a method of determining individual currents being supplied to two ESPs in a subsea pumping and booster system. The two ESPs are electrically connected by a parallel electrical connection comprising a splitter, a first branch extending from the splitter to a first of the two ESPs, and a second branch extending from the splitter to a second of the two ESPs. The method comprises: determining a first temperature ($T_1$) of the first branch; determining a second temperature ($T_2$) of the second branch; determining a total electrical current ($I_{total}$) supplied to the splitter; calculating a first current ($I_1$) being supplied to the first of the two ESPs via the first branch; and calculating a second current ($I_2$) being supplied to the second of the two ESPs via the second branch.

In an embodiment of the above, the calculating of the first and second current ($I_1$, $I_2$) is achieved by solving the following three simultaneous equations i)-iii):

$$I_{total} = I_1 + I_2 \quad \text{i)}$$

$$T_1 = T_a + b(I_1)^2 \quad \text{ii)}$$

$$T_2 = T_a + b(I_2)^2 \quad \text{iii)}$$

where $T_a$ is the ambient temperature around the branch being measured and b is the heat transfer coefficient of the branch being measured.

In yet a further aspect of the present disclosure, the subsea pump and booster system of the earlier aspect having a processing unit includes instructions stored in the memory to carry out the method of above aspect and its embodiments.

Although certain advantages are discussed below in relation to the features detailed above, other advantages of these features may become apparent to the skilled person following the present disclosure.

BRIEF DESCRIPTION OF DRAWINGS

One or more non-limiting examples will now be described, by way of example only, and with reference to the accompanying figures in which.

DETAILED DESCRIPTION

Figure 1:
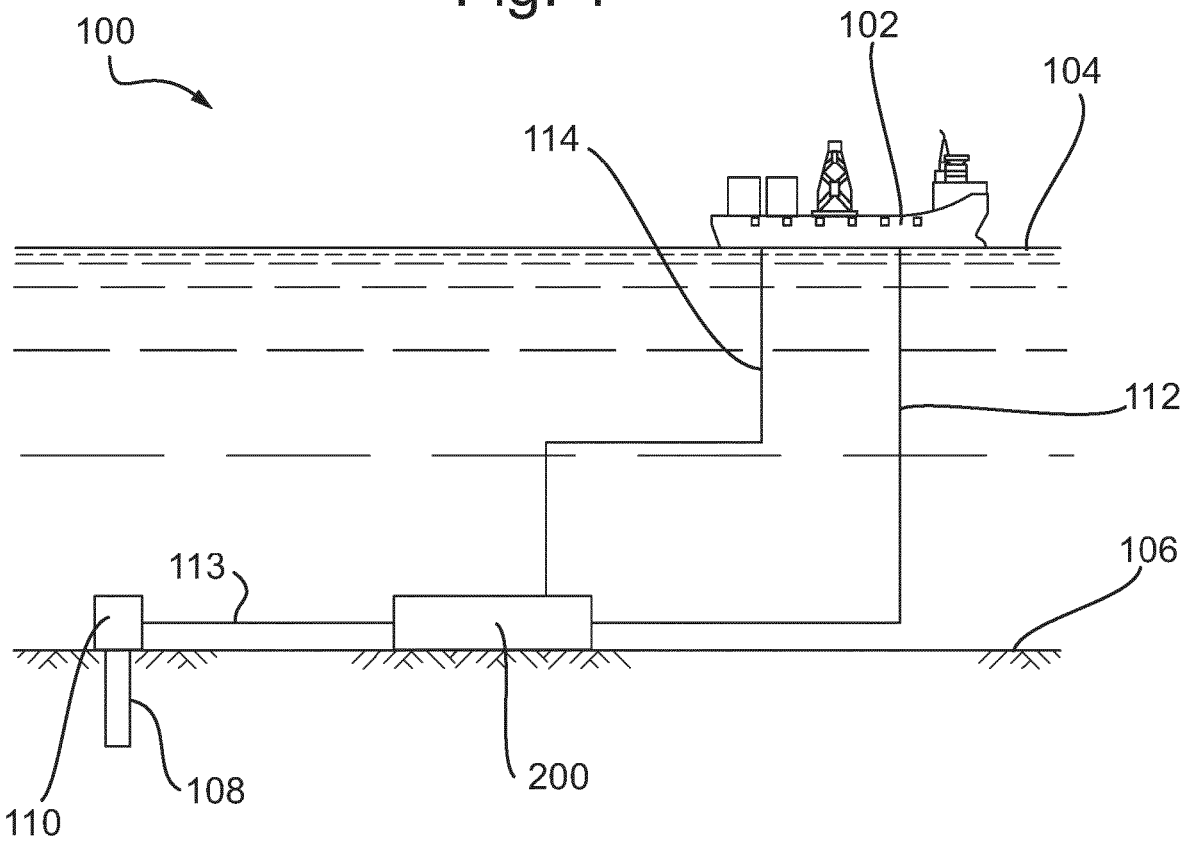
FIG. 1 shows a schematic diagram of an offshore staging including a subsea pumping and booster system in accordance with an embodiment of the present disclosure.

FIG. 1 shows a schematic diagram of an embodiment of an offshore recovery staging 100. The staging 100 includes an FPSO unit 102 (in the form of a vessel 102) floating on a sea surface 104, a well 108 defined in a sea floor 106 capped by a subsea tree 110 (e.g., "Christmas tree" or "XT"/"X-Tree"), and a modular subsea pumping and booster system 200.

As will be described further below, the modular pumping and booster system 200 is arranged along the sea floor 106 and includes inlet and outlet connections to facilitate fluid connections between the subsea tree 110 and the vessel 102. In this example, the modular pumping and booster system 200 is landed on the sea floor 106 at an area proximate the tree 110 and then fluidly coupled to the tree 110 and the vessel 102, via riser 112 and flexible or rigid pipe 113. Fluid may thus be directed into the wellbore 108 and/or recovered from the wellbore 108 and returned to the vessel 102 via the riser 112 and pipe 113 using the system 200. An umbilical 114 (e.g., subsea cable) extends from the vessel 102 to the system 200, and is used to supply power to the system 200 and control its operation. The umbilical 114 is accordingly electrically connected to the system 200.

Although the FPSO unit 102 is exemplified as a vessel 102, it could be any other suitable type of FPSO unit 102, such as a rig, platform or other installation. Moreover, although umbilical 114 and riser 112 are depicted as separate lines in FIG. 1, they could be combined into a single structure (e.g., with the two lines being jacketed together to form a single hose structure). This may be beneficial as it reduces the length/amount of cable that must be carried by the FPSO unit 102.

Figure 2:
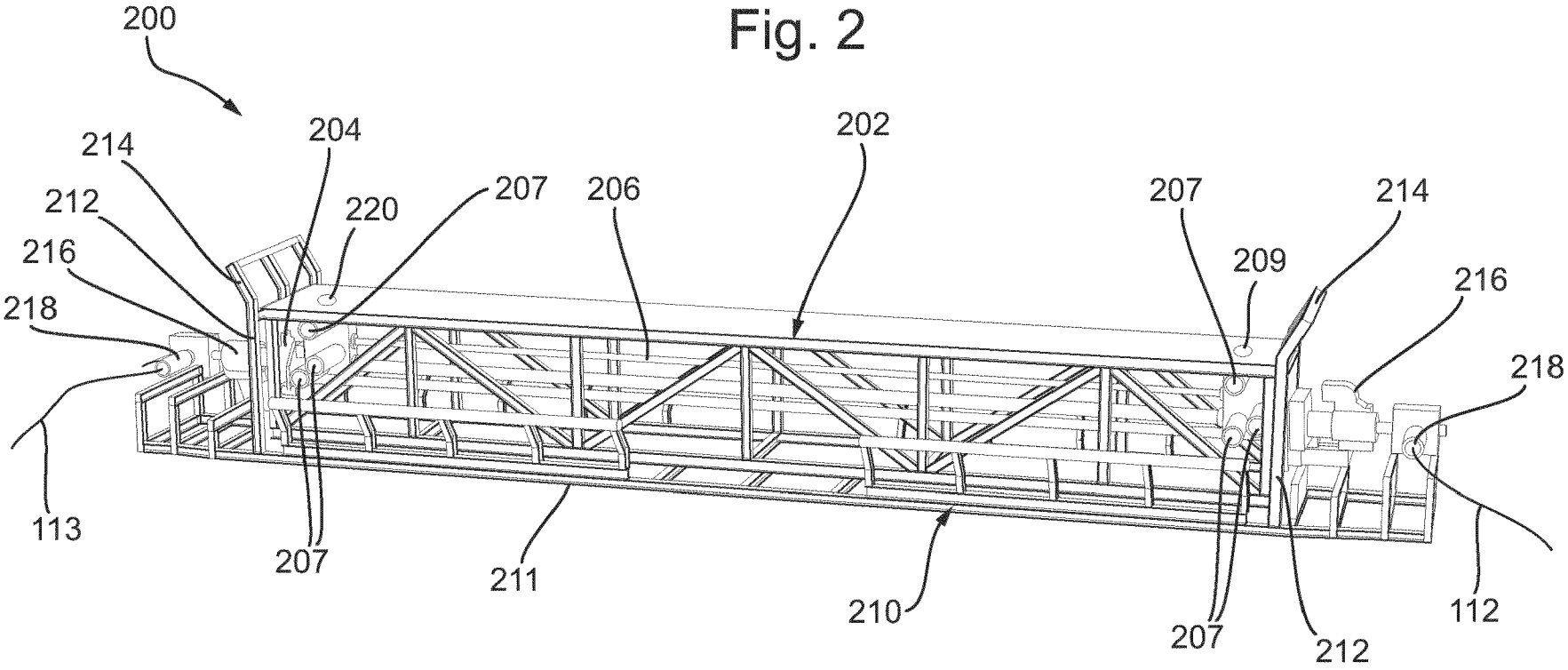
FIG. 2 shows an isometric view of a subsea pumping and boosting system in accordance with an embodiment of the present disclosure.

FIG. 2 shows an isometric view of the pumping and booster system 200. The system 200 includes a pumping unit 202 (e.g., a pumping module) and a base unit 210 that is adapted to receive the pumping unit 202. The pumping unit 202 is assembled and secured on to the base unit 210 either before the system 200 is positioned subsea or in situ (i.e., when the base unit 210 has already been positioned subsea).

In the depicted example, the base unit 210 is adapted to receive the pumping unit 202 in a space defined between posts 212 of the base unit 210. The posts 212 are used to block axial movement of the pumping unit 202 after installation. Moreover, the posts 212 include a sloped upper end 214, which may facilitate installation of the pumping unit 202 onto the base unit 210, for example, by guiding the pumping unit 202 into the space defined between the posts 212.

The base unit 210 includes a bottom portion 211 extending axially between the posts 312 for supporting the base unit 210 on the sea floor 106. It should be appreciated that various reinforcement fittings and the like (not shown) may be incorporated to accommodate the subsea environment.

The pumping unit 202 can be attached to the base unit 210 in a removable/modular manner (e.g., using fasteners, rivets or the like), which may facilitate replacement and maintenance of the pumping unit 202 separately to the base unit 210. Alternatively, the pumping unit 202 can be attached to the base unit 210 in a more permanent manner (e.g., via welding or brazing thereto). It will be appreciated that the chosen attachment method will depend on the intended application and subsea environment. In either case, once attached together, the pumping unit 202 and base unit 210 provide a modular, subsea pumping and booster system 200 that can be positioned on the sea floor 106 and readily retrieved therefrom and moved to other sea floor 106 locations as needed.

The base unit 210 also includes subsea connectors 216, which are secured in to fluid communication with the pumping unit 202 when it is installed. Subsea connectors 216 can include mechanical, hydraulic, or other types of connections. The depicted subsea connectors 216 are arranged in a substantially horizontal configuration. It should be appreciated that this is for illustrative purposes only and that the subsea connectors 216 may be in a vertical configuration or at an angled configuration, among other options. As used herein, horizontal is with reference to a longitudinal axis extending along the base unit 210 (e.g., parallel to the extension of the bottom portion 211). The subsea connectors 216 are used to couple the system 200 to production flow lines, such as the pipe 113 and riser 112 shown in FIG. 2, and direct fluid therefrom to the pumping unit 202. Accordingly, they permit fluid communication between the well 108, pumping unit 202 and FPSO unit 102.

Additionally, in the depicted embodiment, isolation valves 218 are also associated with the base unit 210. These isolation valves 218 are arranged at inlets (e.g., at pipe 113 from tree 110) and outlets (e.g., at riser 112) to the pumping unit 202 (i.e., upstream of the subsea connectors 216) in order to selectively block fluid flow to the subsea connectors 216. This can be used to prevent fluid flow through the system 200 and to/from the well 108 and/or vessel 102, as necessary.

The illustrated pumping unit 202 includes a frame portion 204 and a plurality of tubulars 206, which may be pipe segments. The tubulars 206 are arranged to direct fluid flow from a first end (e.g., at inlet connector 216) to a second end (e.g., at outlet connector 216) of the pumping unit 202.

Two ESPs 208 for boosting fluid pressure are positioned within the tubulars 206 (not visible in FIG. 2). In the depicted examples, the ESPs 208 are arranged in a substantially horizontal configuration within one or more of the tubulars 206; however, this is by way of example only and the ESPs 208 may be in a vertical configuration and/or an angled configuration depending of the specific packaging of the pumping unit 202 used for a particular application. Furthermore, in the same vein, ESPs 208 may not have the same configuration as each other, for example, a first ESP 208*a* may be horizontal and a second ESP 208*b* may be vertical. Accordingly, ESPs 208 may be at a variety of different angles and configurations.

The pumping unit 202 also includes a connector port 209 for receiving the umbilical 114 and providing electrical communication with the ESPs 208.

In one mode of operation, fluids may be directed toward and through the tubulars 206 from the well 108 (via the tree 110 and pipe 113), and the ESPs 208 are operated to add energy (e.g., pressure) to the fluids and communicate them to the vessel 102 (via riser 112). In this sense, the ESPs 208 are able to increase the flow rate and amount of fluids that are recoverable from the well 108, and which are subsequently "produced" by the vessel 102. In another mode of operation, the ESPs 208 are operated to add energy (e.g., pressure) to fluids that are then to be injected into the well 108. As will be apparent to the skilled person, the modes of operation can be changed using various valves 207 that are operable to modify the direction of fluid flow through the tubulars 206. Furthermore, a serialization connector 220 is provided, which can be used to add additional pumping units. These can be positioned on the base unit 210, or on a separate base unit, if needed for a particular application. Such modes of operation are discussed in detail in previous, related patent application number U.S. 63/161,248, and so do not warrant detailed discussion in the present disclosure.

Although one particular configuration of the system 200 with base unit 210 and pumping unit 202 has been depicted and described, this is only to provide context to better understand the general structure and operation of the system 200. Accordingly, within the scope of this disclosure, the particular construction of the pumping unit 202 and base unit 210 (e.g., the arrangement of structural and fluid carrying elements—such as tubulars 206, valves 207, ESPs 208, posts 212, connectors 216, valves 207, 218 etc.) can be readily varied as needed to suit a particular application.

Figure 3:
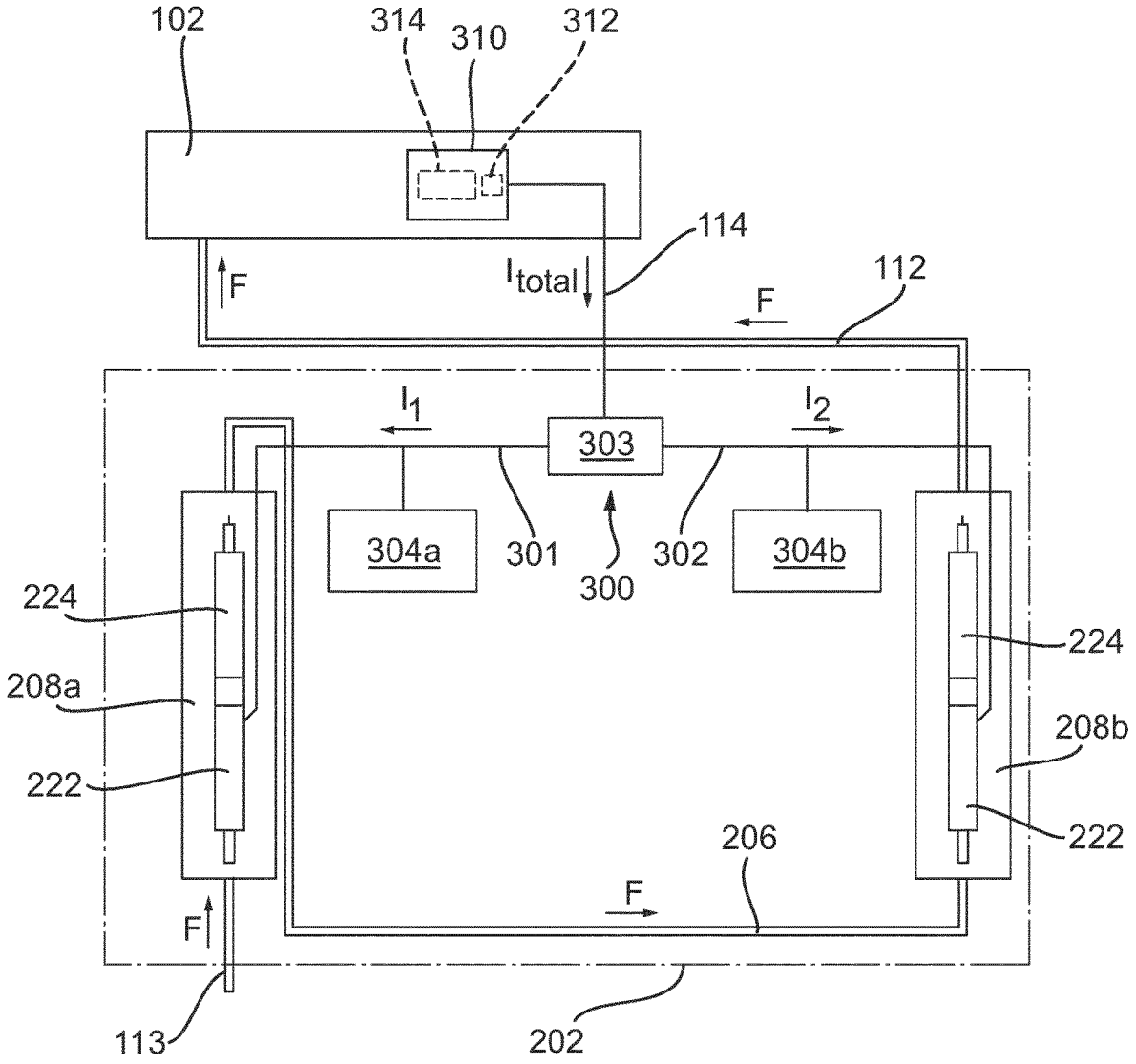
FIG. 3 shows a schematic diagram of the electrical and fluid connections in a subsea pumping and boosting system pumping unit in accordance with an embodiment of the present disclosure.

FIG. 3 highlights the electrical and fluid connections in the pumping unit 202 in more detail.

As discussed above, in one mode of operation, production fluid flow F is directed to the pumping unit 202 by pipe 113. It is then received by a first ESP 208*a*, which is operable to increase the pressure of the production fluid flow F and communicate it to a second ESP 208*b* via tubulars 206. The second ESP 208*b* is operable to increase the pressure of the production fluid flow F further and communicate it to the riser 112 and in turn, the FPSO unit 102.

The ESPs 208*a*, 208*b* each include an electric motor 222 and a pump assembly 224 operably connected thereto. As will be appreciated by the skilled person, the motor 222 is powered to rotate the pump assembly 224, which increases the pressure of the production fluid flow F as it passes there through.

The ESPs 208*a*, 208*b* are electrically connected by a parallel electrical connection 300. The connection 300 comprises a splitter 303, a first branch 301 extending from the splitter 303 to the first ESP 208*a* and a second branch 302 extending from the splitter 303 to the second ESP 208*b*. In particular, the branches 301, 302 connect to the motors 222 of the ESPs 208*a*, 208*b* such that they can provide electrical control thereof.

The umbilical 114 extending from the FPSO unit 102 to the port 209 is electrically connected to the splitter 303. In one example, the splitter 303 is a junction box that takes electrical signals/current from the umbilical 114 and splits it between the branches 301, 302.

In one example, the umbilical 114 and branches 301, 302 provide a three phase cable arrangement. However, any suitable arrangement and numbers of cable(s) may be provided, such as single phase arrangement for example.

An ESP controller 310 is electrically connected to the splitter 303 by the umbilical 114 and operates to supply a total electrical current $I_{total}$ to the splitter 303 to control the operation of the two ESPs 208*a*, 208*b*. The $I_{total}$ is then split by the parallel connection 300 into individual currents $I_1$, $I_2$ that are communicated to a respective one of ESPs 208*a*, 208*b* by the first branch 301 and second branch 302.

The ESP controller 310 may be known as a variable speed drive (VSD), and controls the pumping speed of the ESPs 208*a*, 208*b* by varying the supply of $I_{total}$ (and thus $I_1$, $I_2$) that drives the motors 222 of each ESP 208*a*, 208*b*. Thus, the VSD can be used to vary the production fluid flow F pressure and flow rate through the pumping unit 202 as necessary.

As mentioned above, it has been found that a potential issue with the system 200 and parallel connection 300 is that the individual currents $I_1$, $I_2$ cannot be readily determined during operation. Such parameters are necessary to monitor the health and efficiency of the individual ESPs 208*a*, 208*b* during operations, and so are necessary to ensure successful and repeated implementation of the system 200 in subsea oil and gas production.

It has been discovered that the individual currents $I_1$, $I_2$ can be found by determining the temperature of each of the first and second branches 301, 302. Accordingly, the first branch 301 includes a first temperature sensor 304*a*, and the second branch 302 includes a second temperature sensor 304*b*. The temperature sensors 304*a*, 304*b* are in thermal contact with the first and second branches 301, 302 and are operable to generate data indicative of the temperature thereof.

Figure 4:
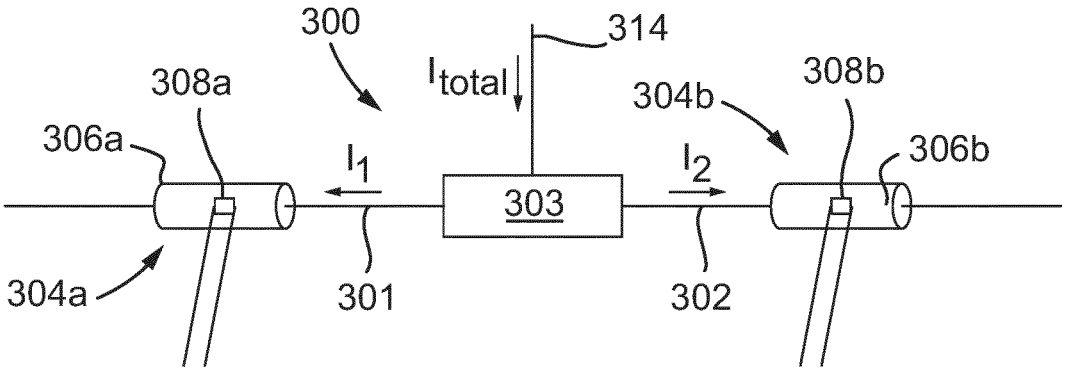
FIG. 4 shows a schematic view of part of the electrical connection shown in FIG. 3 in accordance with an embodiment of the present disclosure.

FIG. 4 shows one embodiment of the temperature sensors 304*a*, 304*b*. In this embodiment, the temperature sensors 304*a*, 304*b* comprises a thermally conductive tube 306*a*, 306*b* surrounding and in thermal contact with the first and second branches 301, 302, respectively. Each of the tubes 306*a*, 306*b* include a temperature sensing element 308*a*, 308*b* (such as a thermistor) attached thereto.

During operation, heat from the branches 301, 302 will be communicated (e.g., via thermal conduction) to the tubes 306*a*, 306*b* and will be measured by the temperature sensing elements 308*a*, 308*b*. The measured temperature (or data indicative thereof—such as thermistor resistance values) can then be communicate by electrical connection (e.g., via wires) to be used for analysis and monitoring.

The tubes 306*a*, 306*b* can be made of any suitable thermally conductive material, such as a metallic material (e.g., stainless steel, aluminium or copper).

The temperature sensors 304*a*, 304*b* and/or branches 301, 302 can be wrapped in an insulating and/or corrosion resistant coating/jacket that is suitable to resist the subsea environment. Such coatings are various and well known in the art, and include resins, foams or thermoplastics. For example, a silicone resin, phenolic resin/foam, or syntactic foam.

Although a particular arrangement of temperature sensors 304*a*, 304*b* is shown, it should be understood that any other suitable arrangement of temperature sensors 304*a*, 304*b* can be used within the scope of the present disclosure. For example, the temperature sensing elements 308*a*, 308*b* can be connected directly to the first and second branches 301, 302 and tubes 306*a*, 306*b* can be dispensed with. Moreover, in addition to a thermistor type, any other suitable type of temperature sensing elements 308*a*, 308*b* can be used, such as e.g., an optical detecting elements or thermocouples.

The temperature data of each of the first and second branches 301, 302 can be correlated to the amount of current $I_1$, $I_2$ passing there through (and thus being drawn by each motor 222 to power each ESP 208*a*, 208*b*). As discussed below, the temperature data can thus be communicated to a processing unit, which can be used to determine live values for each current $I_1$, $I_2$ during operation of the pumping unit 202.

In the depicted example, the ESP controller 310 is used as the processing unit that is configured to determine the individual currents $I_1$, $I_2$ from the known $I_{total}$ and the temperature data provided by the first and second temperature sensors 304*a*, 304*b*.

To this end, the ESP controller 310 includes a memory 312 and a processor 314 for use in determining the individual currents $I_1$, $I_2$. The memory 312 is used to store the temperature data received from the first and second temperature sensors 304*a*, 304*b* and the known total electrical current $I_{total}$ being supplied to the splitter 303. The memory 312 also has instructions saved therein for determining the individual currents $I_1$, $I_2$ therefrom (e.g., by calculation from known correlations—discussed in more detail below). The processor 314 can then be used to carry out the instructions in order to allow the individual currents $I_1$, $I_2$ to be determined.

Although the depicted embodiment utilises the ESP controller 310 (or VSD) as the processing unit, it should be understood that the processing unit could be a separate unit from the ESP controller 310. Such a separate unit can be positioned on the FPSO unit 102 or could be an integral part of the pumping unit 202 itself. In the latter example, the processing unit will be configured to receive a measured or known value of $I_{total}$ from the umbilical 114 (e.g., either by communicating with the ESP controller 310/FPSO unit 102 or communicating with the splitter 303).

In accordance with one embodiment, the determination of individual currents $I_1$, $I_2$ can be made by solving for $I_1$ and $I_2$ in the following three simultaneous equations i)-iii):

$$I_{total} = I_1 + I_2 \quad \text{i)}$$

$$T_1 = T_a + b(I_1)^2 \quad \text{ii)}$$

$$T_2 = T_a + b(I_2)^2 \quad \text{iii)}$$

where:

- $T_1$ is the temperature of the first branch 301 received from the first temperature sensor 304*a;*
- $T_2$ is the temperature of the second branch 302 received from the temperature sensor 304*b;*
- $T_a$ is the ambient temperature around the branch being measured (e.g., the ambient temperature of the subsea environment); and
- b is the heat transfer coefficient of the branch being measured.

It should be appreciated that although $T_a$ and b can be measured/known and used in the above equations, they can also be cancelled out when using the known $T_1$, $T_2$, $I_{total}$ to solve for either of $I_1$ and $I_2$. Accordingly, measuring/obtaining values for $T_a$ and b is not absolutely necessary for determining the values of $I_1$ and $I_2$ during operation.

The above equations can be saved in the memory 312 along with instructions for solving them for $I_1$ and $I_2$, which are then carried out by the processor 314.

Although the above three simultaneous are exemplary correlations used to determine $I_1$ and $I_2$, the skilled person having the benefit of this disclosure may be aware of other suitable correlations that can be used to solve for $I_1$ and $I_2$ using $T_1$, $T_2$, $I_{total}$ data. All such correlations and equations can be used to determine $I_1$ and $I_2$ within the scope of the present disclosure.

Figure 5:
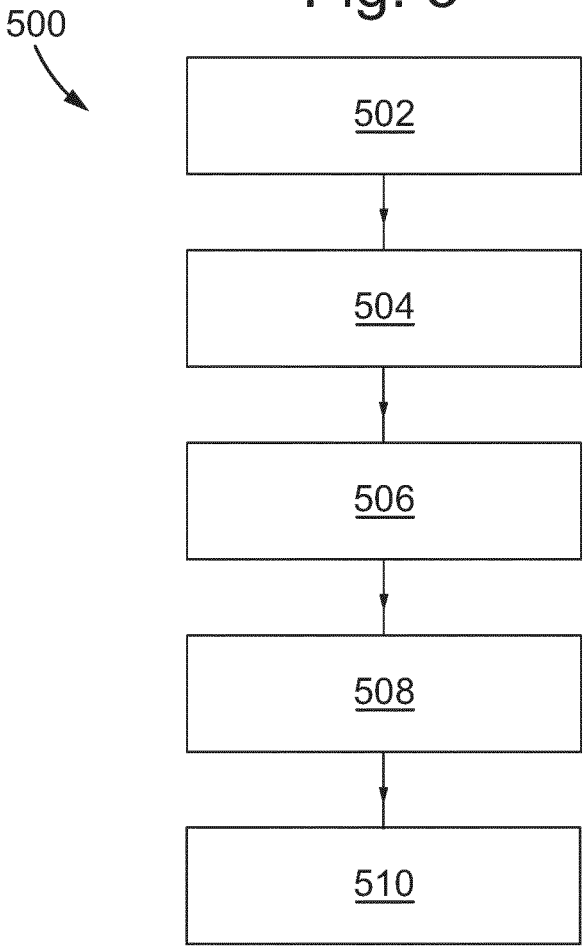
FIG. 5 shows a flow diagram of a method of determining individual currents being supplied to each of the two ESPs in the subsea pumping and booster system in accordance with an embodiment of the present disclosure.

The method steps for determining $I_1$ and $I_2$ as discussed above are summarised in FIG. 5, where the method 500 comprises:

- determining the temperature $T_1$ of the first branch 301 (step 502);
- determining the temperature $T_2$ of the second branch 302 (step 504);
- determining the total electrical current $I_{total}$ supplied to the splitter 303 (step 506);
- calculating the current $I_1$ being supplied to ESP 208*a* via the first branch 301 (step 508); and calculating the current $I_2$ being supplied to ESP 208*b* via the second branch (step 510).

Steps 502 and 504 can be carried out by the temperature sensors 304*a*, 304*b*, respectively.

Steps 506 can be carried out by the ESP controller 310 communicating the $I_{total}$ being supplied to the splitter 303 or by measuring the $I_{total}$ supplied to the splitter 303.

Steps 508 and 510 can be carried out by solving the aforementioned simultaneous equations i)-iii).

As discussed above, the $T_1$, $T_2$, $I_{total}$ data from steps 502-506 can be received and stored in the memory 312 of the processing unit 310, and the calculations of steps 508-510 can be carried out by a processor 314 of the processing unit 310 following instructions also stored in the memory 312. The instructions can cause the $T_1$, $T_2$, $I_{total}$ data to be input into the equations i)-iii) and solve them to calculate and output the corresponding $I_1$ and $I_2$ values.

It is to be appreciated that the present disclosure thus provides a relatively simple means of determining and monitoring $I_1$ and $I_2$ in the subsea pumping and booster system 200. This provides a more effective means of monitoring the health and efficiency of both ESPs 208*a*, 208*b* individually during operation. This can ensure operational safety and wider adoption of the modular system 200. The features of the present disclosure are also relatively easy to retroactively integrate into existing modular subsea pumping and booster systems (e.g., by adding the necessary temperature sensors thereto), which provides cost and maintenance benefits.

Although the present disclosure focuses on two ESPs 208*a*, 208*b* electrically connected in parallel, it should be understood that any number of parallel connected ESPs can be used and benefit from the present disclosure. For example, by adding temperature sensors to the branches thereof the individual currents of the ESPs can be determined in a similar manner.

Moreover, although the ESPs 208*a*, 208*b* are shown as fluidly connected in series (i.e., production fluid passes through the ESPs 208*a*, 208*b* in series), the present disclosure will still apply to arrangements where the ESPs 208*a*, 208*b* are fluidly connected in parallel or have individual fluid connections, as long as they are electrically connected in parallel.

Although certain embodiments have been described and depicted, these are by way of example only, and various modifications and alternative embodiments may fall within the scope of the present disclosure as defined by the appended claims.

The invention claimed is:

1. A subsea pumping and booster system, comprising:

a pumping unit including two electric submersible pumps (ESPs) for receiving production fluid from a well and being operable to increase a pressure of the production fluid;

wherein the two ESPs are electrically connected by a parallel electrical connection, the parallel electrical connection comprising:

a splitter;

a first branch extending from the splitter to a first of the two ESPs; and, a second branch extending from the splitter to a second of the two ESPs;

wherein the first branch comprises a first temperature sensor, and the second branch comprises a second temperature sensor; and a processing unit configured to:

receive temperature data from the first and second temperature sensors of the two ESPs and a measure of a total electrical current supplied to the splitter during operation; and, determine individual electrical currents being supplied to each of the first and second ESPs via the first and second branches, respectively, therefrom.

2. The subsea pumping and booster system of claim 1, wherein the first and second temperature sensors each comprise:

a thermally conductive tube surrounding and in thermal contact with the first and second branches, respectively; and, a temperature sensing element attached to the thermally conductive tube.

3. The subsea pumping and booster system of claim 1, wherein the first and second temperature sensors each comprise a temperature sensing element connected directly to the first and second branches, respectively.

4. The subsea pumping and booster system of claim 2, wherein the temperature sensing element is a thermistor.

5. The subsea pumping and booster system of claim 1, further comprising a plurality of tubulars for directing flow from a first end to a second end of the pumping unit, wherein the two ESPs are positioned within the plurality of tubulars and are configured to increase the pressure of production fluid to direct it from the first end to the second end.

6. The subsea pumping and booster system of claim 1, further comprising a base unit, adapted to receive the pumping unit.

7. The subsea pumping and booster system of claim 6, wherein the base unit comprises a subsea connector for receiving a production line and directing production fluid toward the pumping unit.

8. The subsea pumping and booster system of claim 7, wherein the base unit comprises an isolation valve to block flow of production fluid to the subsea connector.

9. The subsea pump and booster system of claim 1, wherein the processing unit includes:

a memory for storing the temperature data from the first and second temperature sensors and the total electrical current value and having instructions saved therein for determining the individual currents being supplied to each of the first and second ESPs using the temperature data and the total electrical current value; and, a processor for carrying out the instructions.

10. The subsea pump and booster system of claim 1, further comprising an ESP controller electrically connected to the splitter by an umbilical and operable to supply the total electrical current to the splitter that is split between the first and second branches to control the two ESPs.

11. A floating production storage and offloading (FPSO) unit connected to the subsea pump and booster system of claim 10, wherein the umbilical extends from the FPSO unit to the subsea pump and booster system, the ESP controller is positioned on the FPSO unit and is a variable speed drive (VSD) for controlling the speed of the two ESPs; and, a riser extends from the FPSO unit and is connected to the subsea pump and booster system, and production fluid is communicated to the FPSO from the subsea pump and booster system via the riser.

12. A method of determining individual currents being supplied to two ESPs in a subsea pumping and booster system, wherein the two electric submersible pumps (ESPs) are electrically connected by a parallel electrical connection comprising a splitter, a first branch extending from the splitter to a first of the two ESPs, and a second branch extending from the splitter to a second of the two ESPs, the method comprising:

determining a first temperature ($T_1$) of the first branch;

determining a second temperature ($T_2$) of the second branch;

determining a total electrical current ($I_{total}$) supplied to the splitter;

calculating a first current ($I_1$) being supplied to the first of the two ESPs via the first branch; and, calculating a second current ($I_2$) being supplied to the second of the two ESPs via the second branch.

13. The method of claim 12, wherein the calculating of the first and second current ($I_1$, $I_2$) is achieved by solving the following three simultaneous equations i)-iii):

$$I_{total} = I_1 + I_2 \quad \text{i)}$$

$$T_1 = T_a + b(I_1)^2 \quad \text{ii)}$$

$$T_2 = T_a + b(I_2)^2 \quad \text{iii)}$$

where $T_a$ is the ambient temperature around the branch being measured and b is the heat transfer coefficient of the branch being measured.

14. The subsea pump and booster system of claim 9, wherein the instructions stored in the memory are to carry out a method of determining individual currents being supplied to two ESPs in a subsea pumping and booster system, wherein the two ESPs are electrically connected by a parallel electrical connection comprising a splitter, a first branch extending from the splitter to a first of the two ESPs, and a second branch extending from the splitter to a second of the two ESPs, the method comprising:

determining a first temperature ($T_1$) of the first branch;

determining a second temperature ($T_2$) of the second branch; determining a total electrical current ($I_{total}$) supplied to the splitter;

calculating a first current ($I_1$) being supplied to the first of the two ESPs via the first branch; and, calculating a second current ($I_2$) being supplied to the second of the two ESPs via the second branch.

* * * * *